United States Patent [19]

Manns

[11] 4,452,258

[45] Jun. 5, 1984

[54] CONTAINER FOR PIPES

[76] Inventor: Walter J. Manns, 20663 Beachcliff Blvd., Rocky River, Ohio 44116

[21] Appl. No.: 378,671

[22] Filed: May 17, 1982

[51] Int. Cl.[3] ..... A24F 9/14; A24F 9/16

[52] U.S. Cl. ..... 131/329; 131/226; 131/230

[58] Field of Search ..... 131/226, 230, 329, 222, 131/259

[56] References Cited

U.S. PATENT DOCUMENTS

| | | | |
|---|---|---|---|
| 418,511 | 12/1889 | Forster | 131/230 |
| 1,862,133 | 6/1932 | Bayan | 131/226 |
| 3,312,228 | 4/1967 | Fassbender | 131/226 |

*Primary Examiner*—Vincent Millin
*Assistant Examiner*—Harry J. Macey
*Attorney, Agent, or Firm*—J. Helen Slough

[57] ABSTRACT

A pipe smoker's container or case comprises a container having secured therein holding means for securing detachable pipe bowls from detachable smoker's pipes of the type having a pipe stem detachable from or adapted to be attached to the pipe bowl. The pipe bowls each are provided with a tobacco or other smoking material receiving chamber open at both ends and adapted to be secured within the container in position perpendicular to the bottom of the container and in secure engagement with means secured to or provided by the interior of the container lid, whereby the pipe bowls are secured and sealed while carried in the container. A bottom drawhole of the bowl is adapted to be closed by means carried by the bottom of the container. The tobacco or other smoking material receiving chamber in the bowl may be prefilled with tobacco or other smoking material and the prepacked tobacco or other smoking material prevented by the holding means and lid means from spillage during carrying of the container. Both the prefilled pipe bowls and empty used pipe bowls can be efficiently stored within the container.

13 Claims, 7 Drawing Figures

CONTAINER FOR PIPES

This invention pertains to a portable smoker's container or case and particularly relates to a container for carrying a plurality of replaceable bowls for either carrying pipe tobacco or other smoking material prepacked in said pipe bowls or additional fresh bowls for a pipe etc. which container or case can be easily carried in a coat pocket.

Containers for pipes and pipe tobacco are known, such as U.S. Pat. No. 2,447,084 directed to a pipe holder cabinet, or U.S. Pat. No. 1,862,133 directed to wrapped tobacco for pipes. A two-piece detachable smoker's pipe is shown in U.S. Pat. No. 2,729,216 wherein the pipe bowl is detachable from the pipe stem by a screw fit connection between the pipe bowl and the pipe stem.

It now has been found that detachable smoker's pipes of a type as shown in U.S. Pat. No. 2,729,216 and similarly detachable pipes can be used in conjunction with a smoker's container or carrying case particularly adapted to secure by mount therein a plurality of prepacked or used detached pipe bowls. The pipe bowls advantageously are secured within the container in a position perpendicular to the bottom of the case or container whereupon the container top or means associated therewith is employed to seal the open pipe bowls to maintain any contents in the sealed pipe bowls inviolate and prevent spillage thereof during transport or storage in the pocket or elsewhere.

Briefly, the invention pertains to a smoker's portable container or case comprising a bottom or base portion adapted to support and to close an opening in the bottom of a tobacco or other smoking material receiving chamber in each of a plurality of detached pipe bowls supported in the perpendicular position referred to above and a container top or lid portion having means for covering an opening in a tobacco or other smoking material receiving chamber in the open pipe bowls to maintain the contents in the pipe bowls and prevent spillage while carrying the smoker's container in any position. The individual pipe bowls can be easily removed from the smoker's container one at a time and used by securing the pipe bowl to a pipe stem whether a pipe stem carried in the container or a separate pipe stem and a pipe bowl from the container can replace the fresh bowl removed from its seated portion in the container or placed in a vacated position in the container.

A major advantage of the smoker's container lies in the fact that prepacked pipe bowls can be maintained fresh and secure but easily accessible while traveling or at a function remote from one's residence. A further advantage is that a pipe smoker can quickly and easily replace a used pipe bowl with a fresh packed bowl without cleaning or removing the smoked tobacco and thus avoid the somewhat messy cleaning of stem and/or bowl necessary to prepare a new bowl of tobacco. The smoker's container is preferably slim in design and can be easily and comfortably slipped into a coat pocket in any direction without spilling tobacco therefrom and further may avoid the necessity for carrying a bag of tobacco. Still further, the portable smoker's container is simple in construction comprising but few parts and can be efficiently assembled with minimal expense. These and other advantages will become more apparent from the drawings and detailed description of the invention.

IN THE DRAWINGS

Figure 1:
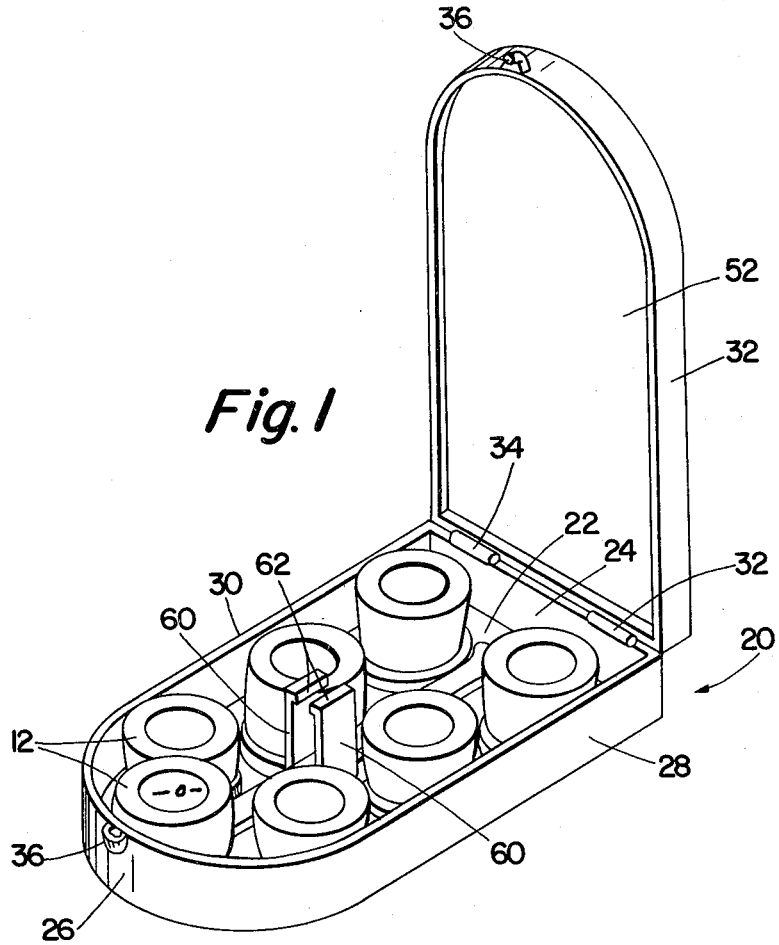
FIG. 1 is a perspective view of the portable smoker's container with the container lid open exposing pipe bowls secured to the interior of the bottom of the container in accordance with this invention.

Referring now to the drawing wherein like characters designate like parts, in FIG. 1 a portable smoker's container 20 is shown which comprises a bottom portion, side wall portions, and a lid, as shown, it contains detachable pipe bowls 12 in accordance with the invention.

The smoker's container 20 comprises a hollow container having a bottom 22, a rearward vertical wall 24, a forward vertical wall 26, and vertical side walls 28, 30 and a lid 32. The container 20 preferably has a rounded forward side wall 26 as best viewed in FIG. 1. The lid 32 can be hinged as shown at 34 or slideably engaged for top snap-on engagement with the container sidewalls. The lid 32 can be secured with a latch 36 to the bottom as shown.

Figure 4:
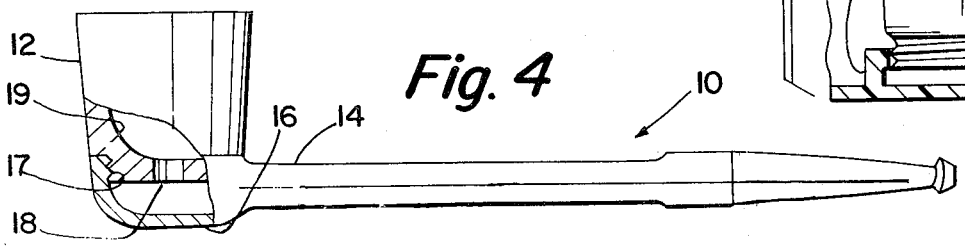
FIG. 4 is a side elevation view of a type of pipe wherein the pipe bowl is detachable from the pipe stem.

The container 20 is adapted to secure detachable pipe bowls 12 of a detachable pipe 10 of the type shown in FIG. 4. The detachable pipe 10 includes a pipe stem 14 and an open pipe bowl 12 adapted to be secured to a dish shaped bowl support 16 of the stem, the bowl 12 preferably having exterior threads 13 adapted for screw-fit engagement with interior threads 17 of the bowl support 16. The pipe bowl 12 includes a small centrally disposed draw hole 18 in the bottom-most portion of the bowl 12 as well as a large opening "o" in the top of the bowl and a relatively large tobacco or other smoking material chamber 19 disposed within the pipe bowl 12 for receiving and holding pipe tobacco or other smoking material during smoking.

Inside the container 20, a plurality of pipe bowl holding means 40 are secured to the container bottom 22 in spaced relationship wherein each of the plurality of bowl holding means 40 individually secures a separate pipe bowl 12 to the bottom of the container 20. The bowl holding means can be any of one of a wide variety holding means such as a dished socket 42 as shown at the far left of FIG. 2 having interior threads 43 adapted to engage the exterior threads 17 of the pipe bowl 12; or the bowl holding means can be provided with a resilient shoulder 45 having an inwardly protruding rib or peripheral lip 46 which, as shown centrally in FIG. 2, engages the threaded portion 17 of the pipe bowl 12; or the bowl holding means can be a friction fit socket 48, as shown at the right side in FIG. 2. The bowl holding means can further include an upwardly directed centrally disposed small blunt peg 50 adapted to engage and close the draw hole 18 disposed in the bottom of the pipe bowl 12. FIG. 3 shows still another resilient impinging suction means 51 for securely engaging the pipe bowl 12.

Figure 2:
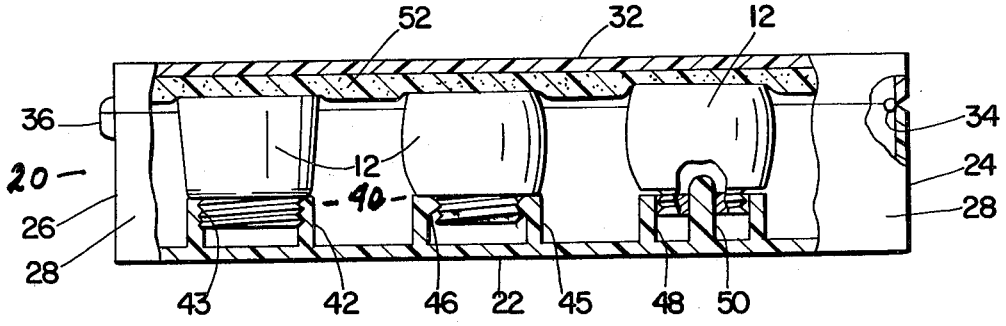
FIG. 2 is a side elevation view of the smoker's container shown in FIG. 1 with a portion of the side removed to expose the inside of the container.
Figure 3:
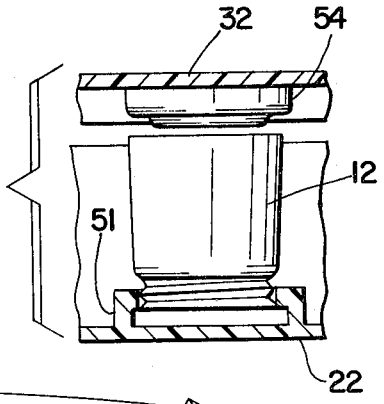
FIG. 3 is a side elevation view of individual pipe bowl and means for sealing the top of the bowl.

The container lid 32, as further shown in FIG. 2, contains sealing means 52 secured to the underside surface of the lid 32 and adapted to securely cover and seal the open tops of the pipe bowls 12 and particularly the bowl chamber 19 containing prepacked tobacco or other smoking material and/or used pipe bowls 12. The lid sealing means 52 can comprise a continuous flexible cushion as shown in FIG. 2, or a plurality of individual resilient plug means 54 secured to the lid 32, as shown in FIG. 3, whereby each plug 54 engages and seals an individual pipe bowl 12 upon closing the lid 32. In the said latter construction, the plugs are aligned with the mounting means in the bottom of the container.

Figure 5:
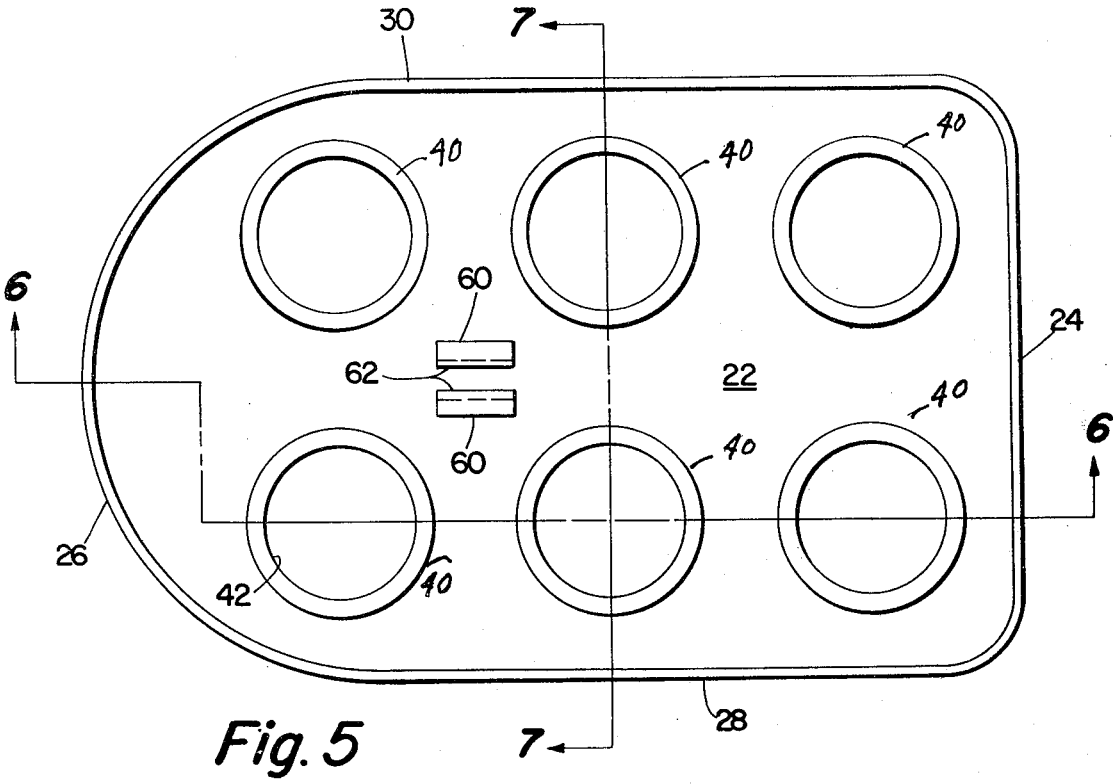
FIG. 5 is a top plan view of the smoker's container with the container lid removed.
Figure 6:
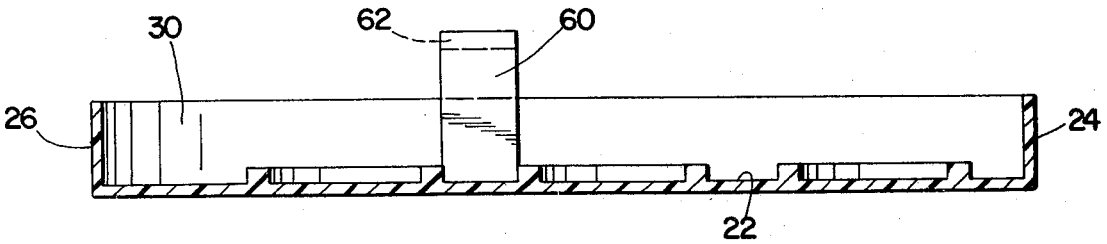
FIG. 6 is a vertical section view taken along line 6—6 in FIG. 5.
Figure 7:
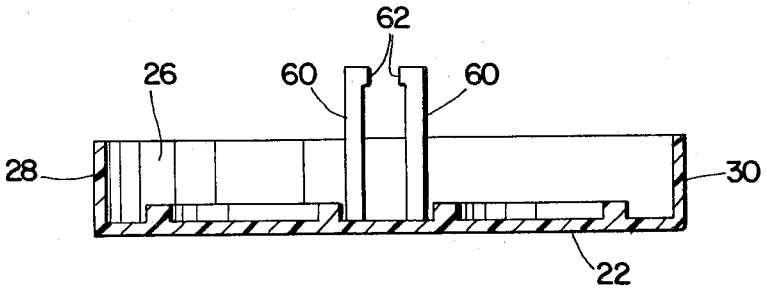
FIG. 7 is a vertical section view taken along line 7—7 in FIG. 5.

The smoker's container 20 can further be provided with a centrally disposed pipe stem holding means secured to the container bottom 22 preferably between the bowl holding means, as best viewed in FIG. 1 as well as FIGS. 5, 6 and 7. The pipe holding means comprises a pair of laterally spaced vertical members 60 having inwardly directed horizontal shoulders 62. The spacings between the horizontal shoulders 62 is preferably only sufficient to permit the pipe stem's narrowest flat portion to pass therebetween and the spacing between the vertical members 60 is slightly greater in extent than the aforesaid spacing between the shoulders whereby the larger breadth portion of the pipe stem engages both vertical members 60, whereby the stem is secured within the container 20 to prevent loose movement of the pipe stem while traveling.

In use, the pipe smoker can prepare his smoker's container by prepacking one, several or more detachable pipe bowls 12 and securing each bowl 12 in a position perpendicular to the bottom of the container and within the container 20 thus sealing the bottom drawhole. The pipe stem 14 or a spare pipe 10 can be secured within the container 20 if desired. The lid 32 is secured to the sidewall portions thereby automatically sealing the open bowl chambers 19 of the bowls 12 from being exposed to air and to maintain the pipe bowls 12 secure and the tobacco or other smoking material packed in the pipe bowls until use. The closed container 20 can be easily slipped into a coat pocket by inserting the rounded forward side 26 into the pocket first. When needed, the smoker's container 20 can be withdrawn from the pocket and opened in an upright position to expose the prepacked pipe bowls 12. A prepacked bowl 12 can be removed from the container 20 and attached to the pipe stem 14, whereupon the new pipe bowl 12 of tobacco or other smoker's material is ready to smoke. After the first bowl 12 is smoked, said bowl 12 is removed from the pipe stem 14 and returned to the container 20, whereupon second bowl 12 can be removed from the container 20 and smoked. The smoker's container 20 effectively eliminates both the cleaning and packing operations in public as well as maintaining the new bowls 12 sealed and prevents used bowls 12 from discharging any contents thereof into the container 20. Thus, the smoker's container 20 advantageously provides the smoker with prepacked bowls 12 of tobacco or other smoker's material as well as a receptacle for used bowls 12.

The foregoing is descriptive of preferred embodiments of the invention, and is not intended to be limiting, except by the appended claims.

I claim:

1. In combination, a portable case consisting of a bottom, raised side wall portions, and a lid adapted to be opened and closed to provide access to the inside of the case, a plurality of pipe bowls containing tobacco or other smoking material, said pipe bowls having an opening in the uppermost and lowermost end thereof, the bottom of the case comprising spaced pipe bowl holding means in which the bottom of the pipe bowls are seated and whereby the opening therein is closed, the lid of the case having means adapted to close the opening in the uppermost end of the bowl.

2. The combination as claimed in claim 1 wherein the pipe bowls contain exterior threaded lower portions, and said bowl holding means comprises a socket having interior threads adapted to engage the pipe bowl exterior threads.

3. The combination as claimed in claim 1 wherein said pipe bowl holding means comprises resilient socket means.

4. The combination as claimed in claim 1 wherein said pipe bowl holding means comprises resilient shoulders having inwardly directed resilient ribs for compressively engaging said pipe bowls.

5. The combination as claimed in claim 4 wherein the impinging ribs comprise a continuous interior lip.

6. The combination as claimed in claim 1 wherein the pipe bowl securing means comprises aa rigid friction means adapted to provide friction engagement to secure said pipe bowls within said container.

7. The combination as claimed in claim 1 wherein the opening in the bottom of the pipe bowl consists in a centrally disposed small draw hole in the bottom portion of the pipe bowl, and said pipe holding means includes a centrally disposed upwardly extending peg adapted to engage said draw hole of the pipe bowl.

8. The combination as claimed in claim 1 wherein the means secured to the interior of said lid comprises a flexible layer adapted to provide sealing engagement with said pipe bowls.

9. The combination as claimed in claim 1 wherein the resilient sealing means comprises individual plug means for sealing each pipe bowl.

10. The combination as claimed in claim 1 wherein said container includes pipe holding means secured to the container bottom for securing a pipe stem within said container.

11. The combination as claimed in claim 1 wherein the plurality of pipe bowl holding means secure pipe bowls containing prepacked tobacco or other smoker's material.

12. The combination as claimed in claim 1 wherein the pipe bowl holding means secure empty pipe bowls.

13. The combination as claimed in claim 1 wherein the pipe bowl holding means secure pipe bowls containing a prepacked tobacco or other smoking material and used pipe bowls.

* * * * *